US005513513A

United States Patent [19]

Suess et al.

[11] Patent Number: 5,513,513

[45] Date of Patent: May 7, 1996

[54] METAL FORMING TOOL

[76] Inventors: Miland J. Suess, 12155 N. Wildlife Ave., Tucson, Ariz. 85737; Robert H. Nocella, Sr., 9441 E. Kayenta Dr., Tucson, Ariz. 85749

[21] Appl. No.: 293,050

[22] Filed: Aug. 19, 1994

[51] Int. Cl.[6] ..... B21D 51/00

[52] U.S. Cl. ..... 72/409.18; 72/370; 72/415

[58] Field of Search ..... 72/409, 410, 370, 72/412, 415

[56] References Cited

U.S. PATENT DOCUMENTS

| | | | |
|---|---|---|---|
| 74,601 | 2/1868 | Rothschild . | |
| 652,359 | 6/1900 | Haigh | 72/409 |
| 844,885 | 2/1907 | Morden | 72/409 |
| 978,430 | 12/1910 | Braswell . | |
| 2,347,390 | 4/1944 | Baldwin | 72/409 |
| 2,556,538 | 6/1951 | Hauschild | 81/15 |
| 2,571,691 | 10/1951 | Dodge | 72/409 |
| 2,583,625 | 1/1952 | Bergan | 140/106 |
| 2,637,231 | 5/1953 | Schopp | 81/15 |
| 2,828,780 | 4/1958 | Gray | 140/123 |
| 3,597,775 | 8/1971 | McCasland | 7/5.3 |
| 3,680,351 | 8/1972 | Koshinen | 72/409 |
| 3,956,950 | 5/1976 | Jamell | 81/426 |
| 4,739,918 | 4/1988 | Stokes et al. | 228/173.6 |
| 5,084,935 | 2/1992 | Kalthoff | 7/132 |

FOREIGN PATENT DOCUMENTS

| | | | |
|---|---|---|---|
| 669598 | 11/1929 | France . | |
| 796806 | 4/1936 | France | 72/410 |
| 626058 | 2/1936 | Germany | 72/412 |
| 507980 | 1/1956 | Italy . | |
| 276724 | 12/1986 | Japan | 72/415 |
| 44706 | 5/1909 | Switzerland . | |
| 238164 | 8/1925 | United Kingdom | 72/409 |
| 535304 | 4/1941 | United Kingdom | 72/412 |

*Primary Examiner*—Daniel C. Crane
*Attorney, Agent, or Firm*—Antonio R. Durando

[57] ABSTRACT

A metal forming tool has a pair of jaws which are pivotally connected to one another. One of the jaws is provided with a channel which is part-circular in longitudinal direction of the channel and defines a part-circular arc in a plane passing through the channel normal to such direction. The other jaw carries a spherical or part-spherical element having a radius equal to that of the arc. When the jaws are closed, the spherical or part-spherical element makes line contact, or approximately line contact, with the channel in a plane perpendicular to the longitudinal direction of the channel.

7 Claims, 2 Drawing Sheets

METAL FORMING TOOL

BACKGROUND OF THE INVENTION

1. Field of the Invention

The invention relates to a metal forming tool.

2. Description of the Prior Art

A bangle bracelet is conventionally produced by drop-forging a strip of sheet stock. The drop-forging operation bends the strip into a circular band and at the same time forms a circumferentially extending channel in the band.

This procedure has several drawbacks. To begin with, the surface of the strip is damaged during drop-forging and requires time-consuming repair work. Furthermore, the channel-like shape of the circular band precludes the use of a slip joint for connecting the ends of the band to one another and these must be welded, brazed or soldered to each other, which are all operations difficult to perform on a concave or convex surface of a circular strip of metal. In addition, engraving becomes a difficult matter because it must be carried out after drop-forging when the surfaces to be engraved are curved.

In view of the above, it would be desirable to replace the drop-forging operation. However, this requires a metal forming tool capable of forming a channel in sheet material.

Various types of metal forming tools are known. Thus, U.S. Pat. No. 74,601 discloses pliers for bending sheet metal. The pliers have a hollow or concave jaw which cooperates with a corrugated or ribbed jaw.

U.S. Pat. No. 978,430 shows a tool for forming dental crowns. The tool comprises a concave jaw and a convex jaw which carry tooth-like dies for shaping a crown to final form.

U.S. Pat. No. 2,556,538 teaches a tool for repairing automobile moldings. The tool includes one jaw provided with a channel or gutter and another jaw provided with a shaping or molding rib.

U.S. Pat. No. 2,583,625 illustrates a tool for crimping tubular members, such as electrical terminals, onto electrical connectors. The tool has an indentor jaw with alternate depressions and protrusions, and two of the protrusions function as forming elements. The tool also has a nest jaw provided with alternate depressions and protrusions, and two of the depressions cooperate with the forming protrusions on the indentor jaw to crimp tubular members.

U.S. Pat. No. 2,637,231 discloses tube bending pliers. The two jaws of the pliers are formed with complementary, part-cylindrical, V-shaped grooves.

U.S. Pat. No. 2,828,780 shows wire forming pliers. One jaw of the pliers is provided with a die slot while the other jaw is provided with a forming projection which forces the free end of a wire into the die slot so as to shape the end of the wire.

U.S. Pat. No. 3,597,775 teaches a tool for making sinkers to be used with a fishing line. Each of the jaws has alternating depressions and protrusions, and two of the protrusions on one jaw cooperate with two of the depressions on the other jaw. The protrusions which cooperate with the depressions respectively function to form a groove in a sinker and to open a sinker.

U.S. Pat. No. 3,680,351 illustrates pliers for producing dilations in a branch pipe to be connected to a main pipe. One jaw of the pliers is provided with a hole and the other jaw of the pliers is provided with a projection which is arranged to enter the hole.

U.S. Pat. No. 3,956,950 discloses a tool for forming eyes on electrical wire. The tool comprises a first elongated jaw having a semicircular, longitudinally extending passage with spaced, transversely extending grooves for wires of different size. The tool further comprises a second elongated jaw of truncated configuration designed to cooperate with the first jaw.

U.S. Pat. No. 4,739,918 shows a tool for producing raised dimples in header plates. The tool includes two jaws, and one of the jaws has an end face provided with a part-spherical recess while the other jaw has a projection with a part-spherical end. The recess is designed to receive the part-spherical end of the projection.

U.S. Pat. No. 5,084,935 teaches a multipurpose, pliers-like tool for use in dentistry. Among the many features of the tool are two pairs of complementary male and female corrugating elements, a wire bending arrangement including an elongated groove and an elongated rib receivable in the groove, and a channel which can receive, in part, the free end of a cone.

French Patent No. 669,598 illustrates a tool having a first jaw with a wide, arcuate channel and a second jaw with a narrow groove.

Swiss Patent No. 44,706 discloses a tool with two sets of dies. Each die is formed with an arcuate groove.

Finally, Italian Patent No. 507,980 shows a pliers-like tool in which each jaw is again provided with an arcuate groove.

None of the above tools is designed to form a channel in sheet stock and, at the same time, impart longitudinal curvature to the sheet to provide an outwardly-convex band configuration.

BRIEF SUMMARY OF THE INVENTION

It is an object of the invention to provide a tool capable of producing a channel in sheet material with little or no damage to the surface of the material.

It is also a goal of the invention to provide a tool capable of producing a channel in sheet material that has been curved and joined to form a flat band prior to application of the tool.

Another object of the invention is to provide a tool which, while producing a channel in a strip of sheet metal, may also be used to impart a desired curvature in the longitudinal direction of the channel, thereby producing an outwardly-convex circular structure.

Another object of the invention is to provide a tool which allows two ends of a bent length of sheet material to be connected by a slip joint.

An additional object of the invention is to provide a tool which can shape engraved sheet material without destroying the engraved characters.

A further object of the invention is to provide a method which makes it possible to form a channel in sheet material while causing little or no damage to the surface of the material.

Another object of the invention is to provide a method for producing a channel in a strip of sheet metal while also imparting a desired curvature in the longitudinal direction of the channel.

It is also an object of the invention to provide a method which permits two ends of a bent length of sheet material to be linked by a slip joint.

Yet another object of the invention is to provide a method which enables engraved sheet material to be shaped without destruction of the engraved characters.

The preceding objects, as well as others which will become apparent as the description proceeds, are achieved by the invention.

One aspect of the invention resides in a forming tool. The tool comprises a first member having a first forming element, and a second member having a second forming element. The forming elements are movable between an open position in which the forming elements are spaced from one another and a closed position in which the forming elements contact each other. One of the forming elements is provided with a channel which extends in a predetermined direction and defines a part-circular arc in a plane normal to the predetermined direction. The other forming element is provided with a convex, part-spherical surface portion which faces the channel and has a radius substantially equal to that of the arc defined by the channel.

Due to the configurations of the forming elements, the forming elements are in line contact, or approximately line contact, with each other in the closed position thereof. The line contact is established in a plane perpendicular to the longitudinal direction of the channel.

By successively applying the tool of the invention to different locations circumferentially of a bent length of sheet material, the sheet material can be shaped so as to form a circumferentially extending channel therein. By virtue of the fact that the forming elements are designed to make line contact, or approximately line contact, with one another in the closed position of the forming elements, the action of the tool is quite gentle. Accordingly, the surface of the sheet material undergoes little, if any, damage. Moreover, the sheet material can be engraved before it is bent because the tool will not, or will not significantly, affect the engraved characters. This allows engraving of the sheet material to be greatly simplified because it can be performed on the flat metal sheet prior to forming. In addition, it is possible to connect the ends of the bent length of sheet material to one another by a slip joint since formation of a channel in the sheet material can take place after the ends of the sheet material have been overlapped in slip-joint fashion.

Another aspect of the invention resides in a method of making an article with a hollow profile (hollow defined herein as convex or concave, depending on the reference point, or otherwise bent inwardly or outwardly) from sheet material having two ends and defining a predetermined plane. The method comprises the steps of bending the material by moving at least one of the ends out of the predetermined plane towards the other end, and forming a channel in the material which extends in a predetermined direction from one end of the sheet material towards the other. The forming step is performed subsequent to the bending step and includes successively deforming an upstream location and a downstream location of the material as considered in the predetermined direction.

The bending step preferably involves deforming the sheet material into an arcuate configuration. The forming step advantageously comprises shaping the material so that the channel defines a part-circular arc in a plane normal to the predetermined direction.

Depending on the ultimate product desired, the method can preferably further comprise the step of joining the ends of the sheet material to one another prior to the forming step.

BRIEF DESCRIPTION OF THE DRAWINGS

Additional features and advantages of the invention will be forthcoming from the following detailed description of preferred embodiments when read in conjunction with the accompanying drawings.

DESCRIPTION OF THE PREFERRED EMBODIMENTS

Figure 1:
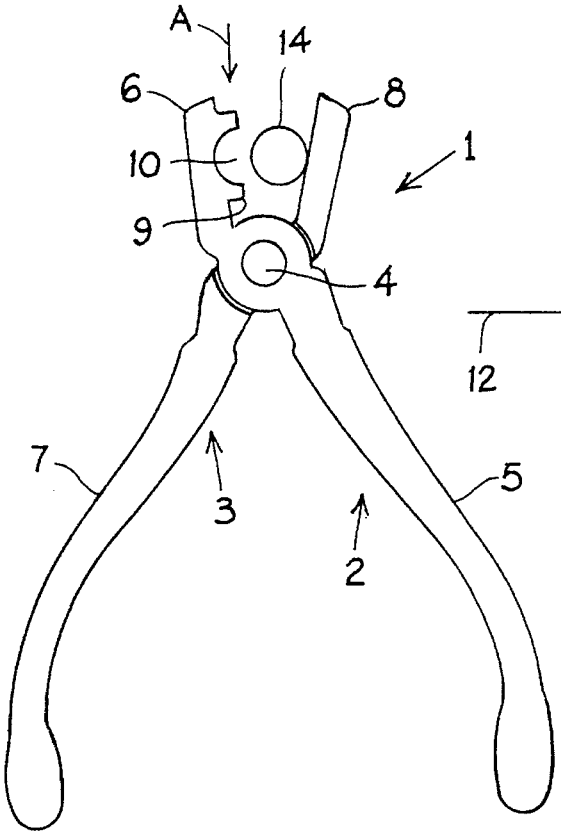
FIG. 1 is a side view of a forming tool according to the invention, the forming tool having a pair of forming elements.

In FIG. 1, a forming tool according to the invention is identified generally by the reference numeral 1. The tool 1 is designed for use in the production of hollow metallic articles from sheet material, particularly annular or part-annular articles of jewelry such as gold and brass earrings, bangle bracelets, etc. The tool 1 has two members 2 and 3 which constitute two-armed levers and are arranged so that the tool 1 resembles pliers. Thus, the members 2 and 3 are pivotally connected to one another by a pivot 4 located between the ends of the members 2 and 3. One arm of the member 2 constitutes a handle 5 of the tool 1 while the other arm constitutes a jaw 6. Similarly, one arm of the member 3 constitutes a handle 7 whereas the second arm of the member 3 constitutes a jaw 8.

Figure 2:
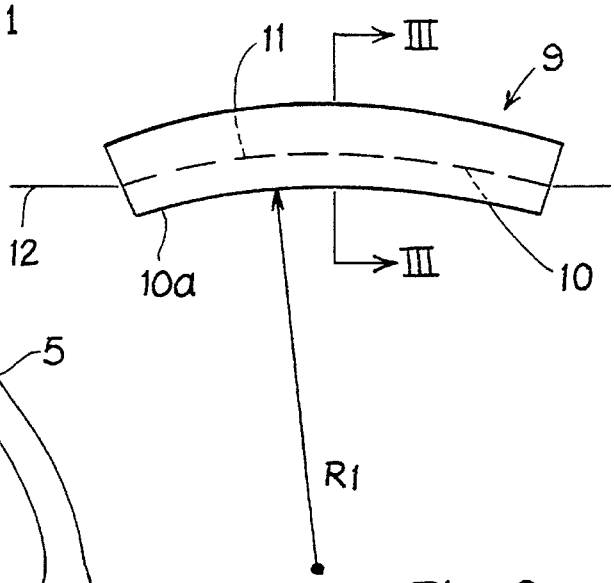
FIG. 2 is an enlarged view, as seen in the direction of the arrow A in FIG. 1, of one of the forming elements of FIG. 1.

The jaw 6 carries a forming or shaping element 9 which is provided with a channel 10. As seen in FIG. 2, the forming element 9 and channel 10 are part-circular as considered longitudinally of the channel 10, and the deepest location of the channel 10 defines an arc 11 having a constant radius and extending in longitudinal direction of the channel 10. The channel 10 is arranged so that a line 12 intersecting the ends of the longitudinal arc 11 is essentially parallel to the pivot 4.

Figure 3:
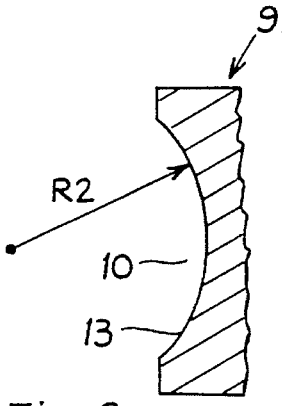
FIG. 3 is a partially cut-out enlarged sectional view of the forming element of FIG. 2 as seen in the direction of the arrows III—III of FIG. 2.

The channel 10 is also part-circular as seen in a plane which intersects the channel 10 normal to its longitudinal direction. FIG. 3 shows that, in such a plane, the channel 10 defines an arc 13 having a constant radius R2.

The jaw 8 supports a spherical or part-spherical forming or shaping element 14 having a convex surface portion which faces the channel 10. The forming element 14 has a radius equal to the radius R2 of the transverse arc 13 of the channel 10. The forming element 14 and channel 10 are arranged in such a manner that, when the tool 1 is moved from the open position of FIG. 1 to a fully closed position, the forming element 14 makes line contact with the channel 10 in a plane perpendicular to the longitudinal direction of the channel 10.

The forming elements 9 and 14 can, for instance, be made of steel. The tool 1 can then be used as a metal forming tool.

Figure 4A:
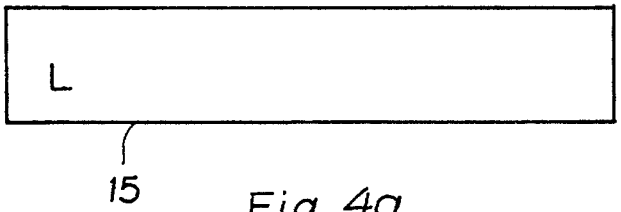
FIG. 4*a* is a plan view of a flat strip of metal, such as gold, to be converted into a bangle bracelet using the tool of FIG. 1.

By way of example, the operation of the tool 1 will be described with reference to the production of a bangle bracelet from a flat strip 15 of gold sheet material illustrated in FIG. 4*a*. If the bracelet is to be engraved, the engraving procedure is carried out at this time because it is easier to engrave the strip 15 while flat than after the strip 15 has been bent. FIG. 4*a* shows a character L engraved in the strip 15. Furthermore, the strip 15 is treated in its flat condition to give the surfaces of the strip 15 the desired texture and to remove undesired marks such as scratches.

Figure 4B:
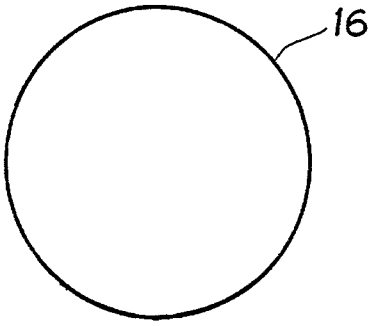
FIG. 4*b* shows the strip of FIG. 4*a* after bending of the strip into a ring shape.
Figure 4C:
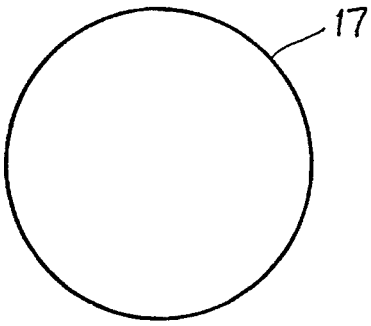
FIG. 4*c* illustrates an annular blank produced by joining the free ends of the ring of FIG. 4*b* to one another.

Once the flat strip 15 has been engraved and its surfaces prepared, the strip 15 is bent into a ring 16 illustrated in FIG. 4*b*. Since the strip 15 is flat, the bending operation can be performed rather easily and without damaging the surfaces of the strip 15. The free ends of the ring 16 are joined to one another to form an annular blank 17 shown in FIG. 4*c*. Joining of the free ends of the ring 16 to each other can be accomplished by providing the free ends with a slip joint or by welding, brazing or soldering the free ends to one another. If the free ends of the ring 16 are welded, brazed or soldered to each other, the area of the joint is treated so that it has the desired surface texture and is essentially free of undesired marks.

Figure 5:
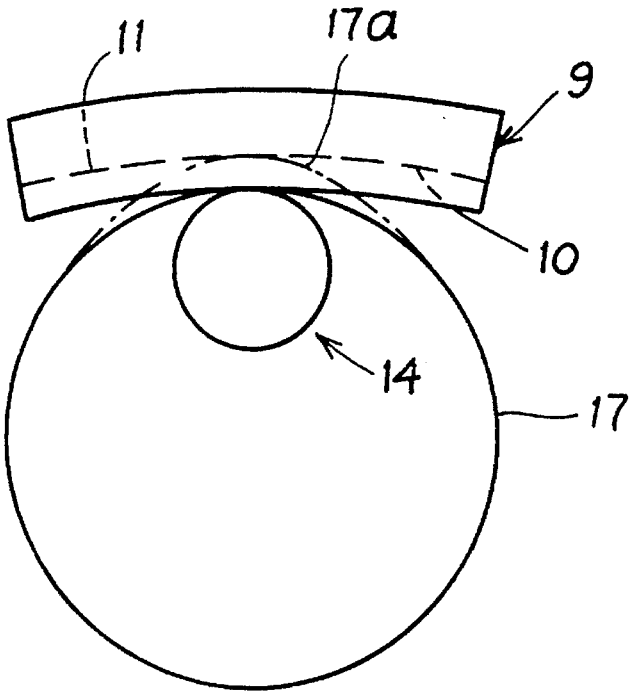
FIG. 5 is an enlarged view of the forming elements of FIG. 1 in position to shape the annular blank of FIG. 4*c*.

The tool 1 is now used to form a circumferentially extending channel in the blank 17. To this end, the blank 17 and the tool 1 are positioned relative to one another in such a manner that the forming element 14 faces the inner surface of the blank 17 and the channel 10 faces the outer surface of the blank 17. This is illustrated in FIG. 5. The width of the blank 17, which is preferably shorter than the arc 13 of the channel 10, extends transverse to the longitudinal direction of the channel 10, and the middle of the width is, as nearly as possible, in register with the deepest location of the channel 10.

Once the tool 1 and the blank 17 have been properly positioned in relation to each other, the tool 1 is moved towards its closed position. As shown by the dash-and-dot line 17*a* in FIG. 5, the forming element 14 then urges the portion (preferably all) of the blank 17 confined between the forming element 14 and the channel 10 into the channel 10. The tool 1 is closed as far as possible so that this portion of the blank 17 is forced against the wall of the channel 10. Since the channel 10 defines a part-circular arc 13 in a plane normal to the longitudinal direction of the channel 10, the edges of the confined portion of the blank 17 are bent inwardly to conform to the channel 10 towards the inside of the annular blank 17. Hence, the blank 17 develops a concavity which faces the center of curvature of the blank 17. The concavity resembles the channel 10 in that the concavity has an arcuate configuration determined by the line contact between the surface of the part-spherical forming element 14 and the conforming curvature of the surface of the channel 10.

Figure 6:
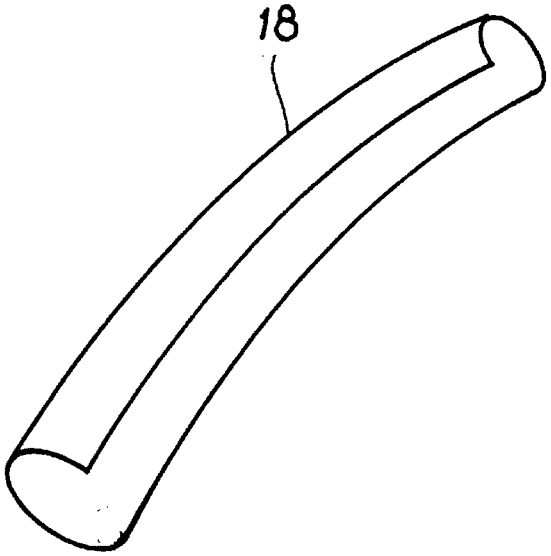
FIG. 6 illustrates a segment of the bangle bracelet obtained when shaping of the annular blank of FIG. 4*c* has been completed.

The tool 1 is now opened and moved a short distance circumferentially of the blank 17 to a second portion of the blank 17 which is shaped in the same manner as the first portion. This procedure is repeated until the individual concavities generated by the tool 1 together define a continuous channel. In order to produce a smooth and unmarked surface, it is sometimes necessary or desirable to repeat the operation several times around the circumference of the bracelet. The resulting product, of which a segment is shown at 18 in FIG. 6, is a bangle bracelet having a continuous channel circumferentially thereof.

Due to the fact that the forming element 14 and channel 10 of the tool 1 are designed to make line contact in the fully closed position of the tool 1, the action of the tool 1 is so gentle that the surface of the blank 17 is not noticeably marked during shaping. Nor does the tool 1 have any noticeable effect on the engraved character L. Moreover, inasmuch as the strip 15 constituting the ring 16 is not provided with a concavity prior to joining the ends of the ring 16 to one another, it is possible to connect the ends of the ring 16 to each other via a slip joint, which may also be provided by overlapping the ends of the strip 15 prior to forming with the tool of the invention.

Referring back to FIG. 2, the longitudinal edges 10*a* of the channel 10 define arcs of radius R1. In order for the tool 1 to properly shape the blank 17, the radius of the blank 17 should be less than or equal to the radius R1.

The invention is described herein in terms of a channel 10 having a cross-section defining an arc 13, but it is understood that the principle and functional characteristics of the invention apply to any sectional geometry of the channel 10 so long as a conforming shaping element 14 is used that provides a line contact between the two surfaces thereof when the tool is moved to a fully closed position. Various other modifications can be made within the meaning and range of equivalence of the appended claims.

We claim:

1. A forming tool, comprising a first member having a first forming element and a second member having a second forming element; said forming elements being movable towards and away from one another between an open position in which said forming elements are spaced from one another and a closed position in which said forming elements contact each other; and said second forming element being provided with a channel which extends in a predetermined direction and is bounded by a surface defining a hollow profile in a plane normal to said predetermined direction, said first forming element including a protrusion which faces said channel and is designed to make essentially line contact with said surface in said plane in said closed position.

2. The tool of claim 1, wherein said channel is arcuate along said predetermined direction.

3. The tool of claim 1, further comprising means connecting said members to one another for pivotal movement between said positions.

4. The tool of claim 1, wherein said surface defines a hollow part-circular arc in a plane normal to said predetermined direction, and wherein said protrusion is at least part-spherical channel and has a radius substantially equal to that of said arc.

5. The tool of claim 4, wherein said channel is arcuate along said predetermined direction.

6. The tool of claim 4, further comprising means connecting said members to one another for pivotal movement between said positions.

7. A forming tool, comprising a first member having a first forming element and a second member having a second forming element; said forming elements being movable towards and away from one another between an open position in which said forming elements are spaced from one another and a closed position in which said forming elements contact each other; and said second forming element being provided with a channel which extends in a predetermined direction and defines a hollow part-circular arc in a plane normal to said predetermined direction, said first forming element being substantially spherical, facing said channel and having a radius substantially equal to that of said arc.

* * * * *